US010952532B2

(12) United States Patent
Nilsson

(10) Patent No.: US 10,952,532 B2
(45) Date of Patent: Mar. 23, 2021

(54) SHELF UNIT FOR A SHELVING SYSTEM AND SHELVING SYSTEM

(71) Applicant: Rickard Nilsson, Balduinstein (DE)

(72) Inventor: Rickard Nilsson, Balduinstein (DE)

( * ) Notice: Subject to any disclaimer, the term of this patent is extended or adjusted under 35 U.S.C. 154(b) by 0 days.

(21) Appl. No.: 16/610,864

(22) PCT Filed: May 8, 2018

(86) PCT No.: PCT/DE2018/100444
§ 371 (c)(1),
(2) Date: Nov. 4, 2019

(87) PCT Pub. No.: WO2018/206053
PCT Pub. Date: Nov. 15, 2018

(65) Prior Publication Data

US 2020/0154907 A1 May 21, 2020

(30) Foreign Application Priority Data

May 9, 2017 (DE) ..... 10 2017 110 002.4

(51) Int. Cl.
*A47B 47/00* (2006.01)
*A47F 5/00* (2006.01)
(Continued)

(52) U.S. Cl.
CPC ..... *A47B 47/00* (2013.01); *A47F 5/005* (2013.01); *A47B 57/58* (2013.01); *A47B 96/021* (2013.01)

(58) Field of Classification Search
CPC ..... A47F 5/005; A47F 96/021; A47F 1/25; A47F 1/26; A47F 1/04; A47F 1/12;
(Continued)

(56) References Cited

U.S. PATENT DOCUMENTS 4,078,664 A * 3/1978 McConnell
4,383,614 A * 5/1983 Miller ..... A47B 57/58 211/59.2
(Continued)

FOREIGN PATENT DOCUMENTS

DE 3540735 A1 5/1987
DE 3644692 A1 7/1988
(Continued)

*Primary Examiner* — Jonathan Liu
*Assistant Examiner* — Devin K Barnett
(74) *Attorney, Agent, or Firm* — Smartpat PLC

(57) ABSTRACT

A shelf unit for a shelving system has a shelf and a support frame carrying the shelf. The support frame has a front frame part, a rear frame part and two lateral frame parts, which are connected to one another to form a through-opening. The shelf is formed by a plurality of elongated floor elements, each of which rests with its longitudinal ends on the front frame part and the rear frame part. The floor elements have an elongated base body with an upper side having a product support surface and with a lower side that, in the area of each longitudinal end of the base body, has a bar that extends in the longitudinal direction of the base body, and is inserted into an insertion receptacle of the support frame of the shelf unit. A shelving system has at least one such shelf unit.

12 Claims, 4 Drawing Sheets

(51) Int. Cl.
*A47B 57/58* (2006.01)
*A47B 96/02* (2006.01)

(58) Field of Classification Search
CPC ..... A47B 47/00; A47B 57/58; A47B 96/021; A47B 96/02; A47B 57/00
USPC ..... 211/184, 59.2, 134, 186
See application file for complete search history.

(56) References Cited

U.S. PATENT DOCUMENTS 4,394,910 A * 7/1983 Miller
4,439,969 A * 4/1984 Bartlett ..... E04D 3/08 52/461
4,454,948 A * 6/1984 Spamer ..... A47F 1/12 108/108
4,724,968 A * 2/1988 Wombacher
4,890,746 A * 1/1990 Trulaske, Sr. ..... A47F 1/12 211/153
4,955,490 A * 9/1990 Schafer
5,259,518 A * 11/1993 Sorenson
5,295,591 A * 3/1994 Slater
5,360,122 A * 11/1994 Benton
5,450,968 A * 9/1995 Bustos
D393,164 S * 4/1998 Russell
5,845,794 A * 12/1998 Highsmith
5,850,720 A * 12/1998 Willis ..... E04F 15/10 52/650.3
5,951,228 A * 9/1999 Pfeiffer
6,082,557 A * 7/2000 Leahy ..... A47B 57/58 211/184
6,237,784 B1 * 5/2001 Primiano ..... A47F 1/12 211/59.2
6,311,852 B1 * 11/2001 Ireland ..... A47F 1/12 211/184
6,314,699 B1 * 11/2001 West ..... E04B 5/023 52/177
6,328,170 B1 * 12/2001 Lee ..... A47F 1/121 211/153
6,332,547 B1 * 12/2001 Shaw ..... A47F 1/12 211/59.2
6,484,467 B2 * 11/2002 Crout ..... E04B 5/12 52/302.1
6,505,386 B1 * 1/2003 Allie
6,520,353 B2 * 2/2003 Fulbright
D472,411 S * 4/2003 Burke ..... D6/706
6,810,633 B2 * 11/2004 Harris, Sr. ..... E04B 5/12 52/489.2
D522,147 S * 5/2006 Morton ..... D25/119
7,207,150 B2 * 4/2007 Leek ..... E04B 5/12 33/526
7,347,336 B1 * 3/2008 Williams ..... A47B 96/021 108/108
7,409,803 B2 * 8/2008 Grohman ..... E04B 5/12 52/489.1
D621,246 S * 8/2010 Heindl ..... D8/382
8,291,666 B1 * 10/2012 Garrison ..... E04B 1/003 52/489.1
8,656,671 B1 * 2/2014 Chambers ..... E04F 15/02044 52/302.1
9,803,376 B1 * 10/2017 Deel ..... E04F 15/06
9,850,667 B2 * 12/2017 Engstrom ..... E04F 15/02044
10,638,856 B2 * 5/2020 Nagel
2002/0121064 A1 * 9/2002 Erwin ..... E04F 15/02172 52/586.1
2005/0028469 A1 * 2/2005 Grohman ..... E04F 15/02 52/480
2006/0059822 A1 * 3/2006 Guffey ..... F16B 5/002 52/480
2006/0196842 A1 9/2006 Taylor et al.
2007/0029270 A1 * 2/2007 Hawkinson ..... A47F 1/126 211/59.3
2008/0155927 A1 * 7/2008 Wendt ..... E04C 3/07 52/506.07
2013/0112640 A1 * 5/2013 Desmond ..... A47F 5/0043 211/153
2013/0153524 A1 * 6/2013 Nilsson ..... A47F 5/00 211/153
2014/0112752 A1 * 4/2014 Hardy ..... A47F 7/281 414/800
2014/0299560 A1 * 10/2014 Kim ..... A47F 1/126 211/59.2
2015/0114918 A1 * 4/2015 Nickell ..... A47F 1/12 211/59.2
2015/0223620 A1 * 8/2015 Nilsson ..... A47B 57/58 211/59.4
2018/0153313 A1 * 6/2018 Padvoiskis

FOREIGN PATENT DOCUMENTS

DE 19609432 C2 4/1998
DE 10148695 A1 3/2003
EP 0858272 B1 4/2004
EP 1559345 A1 8/2005
WO 2016008476 A1 1/2016

* cited by examiner

SHELF UNIT FOR A SHELVING SYSTEM AND SHELVING SYSTEM

TECHNICAL FIELD

The disclosure relates to a shelf unit for a shelving system with a shelf and a support frame supporting the shelf. The disclosure further relates to a shelving system with at least one such shelf unit.

BACKGROUND

A shelf unit for a shelving system with a shelf and a support frame supporting the shelf is known from WO 2016/008476 A1. The support frame there is formed by a front frame part, a rear frame part and two side frame parts, which are assembled to form an interior space. The front frame part and the rear frame part each have a number of slot-shaped openings, which serve as insertion receptacles for the ends of product separators.

The shelf, which is formed by a flat sheet metal part, rests on the front frame part and the rear frame part, and extends to the side frame parts, such that the interior space of the support frame is completely covered. The shelf is therefore relatively bulky and heavy, which is a hindrance when transporting the shelving system or its individual components and when assembling, converting or dismantling the shelving system.

SUMMARY

It is therefore an object of the disclosure to propose at least one option for counteracting the bulky dimensions of a shelf unit of the type mentioned above in a technically simple manner.

This object is achieved with a floor element as described in this specification. This object is further achieved with a shelf unit as described herein. In addition, a shelving system is proposed to achieve the object.

A basic shelf unit for a shelving system, such as a sliding shelving system, has a shelf and a support frame supporting the shelf. The support frame has a front frame part, a rear frame part and two side frame parts, which are connected to each other to form a through-opening or an interior space.

With one embodiment, it is provided that the shelf is formed by a plurality of elongated floor elements or comprises a plurality of elongated floor elements, each of which rests with its longitudinal ends on the front frame part and the rear frame part. Thus, the shelf is created by many individual elements, namely the floor elements. A single large-area shelf is thus avoided. The individual floor elements offer advantages in terms of transport, construction, conversion and/or dismantling of the shelving system, as each individual floor element is relatively small in area. This also makes it easier to clean the shelf, as only individual floor elements, which are dirty, for example, can be cleaned where required.

With a further embodiment, it is provided that, of the floor elements, at least two adjacent floor elements are arranged at a distance from one another, forming an intermediate space, for example at an equal distance, in particular at a constant distance from one another. This saves material for the forming of the shelf. The intermediate space also facilitates ventilation of products on the shelf, for example if the shelf unit is provided as part of a shelving system in a cold-storage room or refrigerated room. In principle, the floor elements can also be arranged in such a manner that a closed surface arises, which surface forms the shelf.

The intermediate space can be designed flexibly in its size. For example, the adjacent floor elements can be arranged at such a distance from each other that a drainage area is specifically formed to allow liquid to drain away, which can originate, for example, from defective products on the shelf. At the same time, the contact surface between products placed on the shelf and the intermediate space is reduced, thus facilitating subsequent slipping if the shelf unit is used as a slide unit in a slide shelf.

It can be provided that the front frame part and the rear frame part each have at least one, preferably a plurality of openings, in particular through-openings, which serve or can be used as insertion receptacles. This allows easy fastening by insertion.

For example, the openings of the front frame part and/or the openings of the rear frame part are arranged at the same distance or at substantially the same distance from each other. For example, the openings of the front frame part and the openings of the rear frame part are each arranged one behind the other in the longitudinal direction of the respective frame part; in particular, they are arranged lying in a row, for example aligned in a row. For example, the openings are formed as slots or similar elongated holes, the longitudinal extension of which extends transversely to the longitudinal direction of the front frame part or the rear frame part.

For example, the openings of the front frame part and the rear frame part are used to fasten product separators. It can be provided that a product separator is arranged between neighboring floor elements (for example, in the intermediate space), which product separator is inserted with its longitudinal ends, on the one hand, into one of the insertion receptacles of the front frame part and, on the other hand, into one of the insertion receptacles of the rear frame part. This makes it easy to fasten the product separators to the support frame. The shelf has no function when the product separator is fastened to the support frame in this way, as the structure of the shelf via the multiple floor elements allows the product separator to be fastened specifically in the area of the support frame that is left free by the floor elements.

According to one aspect, the openings of the front frame part and/or the rear frame part are used to fasten at least one of the floor elements. This gives the openings a multiple function, as they are formed not only for fastening product separators but also for fastening at least one floor element.

An exemplary embodiment of a floor element for a shelf of a shelving system, which can be used as a floor element with the shelf unit described above, comprises an elongated (for example, plate-shaped) base body with an upper side having a product support surface and with a lower side, which in the area of the longitudinal ends of the base body has in each case a bar or the like projecting outwards, which extends in the longitudinal direction of the base body, in order to be inserted at the end into an insertion receptacle of a support frame. This makes it technically simple to fasten the floor element to the support frame, since, for this purpose, the at least one bar or projection is solely inserted into the selected insertion receptacle or receptacles on the support frame. The insertion receptacles can be formed by the openings described above on the front frame part and/or the openings described above on the rear frame part. The support frame can be the support frame of the shelf unit described above.

It is advisable that the bar provided in the area of the respective longitudinal end is provided as a section of a common, continuous bar. This reinforces the floor element against forces or transverse forces acting transversely to the longitudinal direction of the floor element.

Such a floor element can be used with the shelf unit described above in such a manner that the floor element rests with its longitudinal ends on the front frame part and the rear frame part, and is inserted with its respective bar into one of the insertion receptacles of the front frame part and into one of the insertion receptacles of the rear frame part.

All floor elements of the shelving unit or individual floor elements of the shelving unit or only one floor element of the shelving unit can be formed by such a floor element, and thus fastened to the support frame by insertion into one of the openings of the front frame part and/or into one of the openings of the rear frame part.

In the case of the floor element, it is provided in particular that, viewed transversely to the longitudinal extension of the base body, the product support surface extends over the extension of the upper side (in particular, it extends over it completely), in order to place products with a lateral overhang over the upper side on the product support surface. This means that products can be placed on the product support surface, which products protrude laterally over the upper side, for example on both sides. In particular, the upper side is free of any external material sections against which the products could strike. In this manner, a flexible use of the floor element is facilitated for a number of products, regardless of their dimensions.

According to one design, it is provided that the base body and the at least one bar form a T-shaped profile in cross-section. Thereby, the floor element can be realized in a technically simple manner. For example, the T-profile is an isosceles T-profile. This means in particular that the at least one bar separates the area of the base body with the product support surface into two legs of equal or substantially equal size. In principle, the floor element can also be an L-shaped profile in cross-section. For example, one of the legs of the L profile then forms the at least one bar and the other leg has the product support surface.

According to an additional design, several reinforcing ribs are provided on the lower side of the base body, which ribs extend in the longitudinal direction of the base body, wherein the at least one bar projects beyond the reinforcing ribs. A measure is thus taken to strengthen the floor element against forces acting transversely to the longitudinal direction, such as, for example, the weight force of products resting on the floor element.

An additional design consists in the fact that the product support is formed on a sliding layer provided on the upper side of the base body. The sliding layer facilitates the subsequent slipping of the products resting on the floor element if the floor element is used in a sliding shelving system; that is, if it is present in an inclined orientation. For example, the sliding layer is formed by a plastic layer. The sliding layer can contain or consist of at least one polyolefin. The at least one polyolefin can be Teflon or PTFE.

According to an exemplary embodiment, the floor element is a plastic part manufactured by extrusion. For example, the sliding layer is manufactured together with the floor element by co-extrusion. According to another embodiment, the floor element is a metal part. For example, it is provided that the floor element contains or consist of aluminum or an aluminum alloy. The floor element can also be a stainless steel part, which, for example, has or consists of stainless steel. In particular, the floor element has, at least partially or completely, a decorative and/or functional layer. For example, the floor element has a coating that forms the sliding layer in the area of the product support. For example, the floor element is surrounded (in particular, completely surrounded) by a paint layer.

According to yet a different embodiment, the floor element is a hybrid component based on a plastic and a metallic reinforcement insert. The hybrid component can be manufactured by co-extrusion. For example, it is provided that the reinforcing insert contains or consists of aluminum or an aluminum alloy. The plastic base can contain or consist of at least one thermoplastic polymer, such as polyvinyl chloride (PVC), in particular rigid PVC.

It is advisable that the reinforcing insert forms part of the base body and, in particular, extends into the at least one bar. Thereby, the area of the at least one bar is also reinforced by the reinforcing insert.

For example, the reinforcing insert forms a T-shaped profile in cross-section, whereas one leg of the profile extends into the at least one bar. Such a T-shaped profile can be realized in a technically simple manner.

The embodiments of the floor element described above facilitate the formation of a relatively light shelf in terms of weight. At the same time, the floor element has sufficient rigidity to be able to accommodate products on it, without any deformation of the floor element arising, or at least to keep any deformation to a minimum.

According to an additional aspect, a shelving system is provided, which comprises at least one of the shelf units described above and at least two, preferably four, shelf supports, on which the shelf unit is held inclined downwards towards the front frame part.

Additional details and characteristics of the invention can be found in the following description of multiple exemplary embodiments using the drawing.

DETAILED DESCRIPTION

Figure 1:
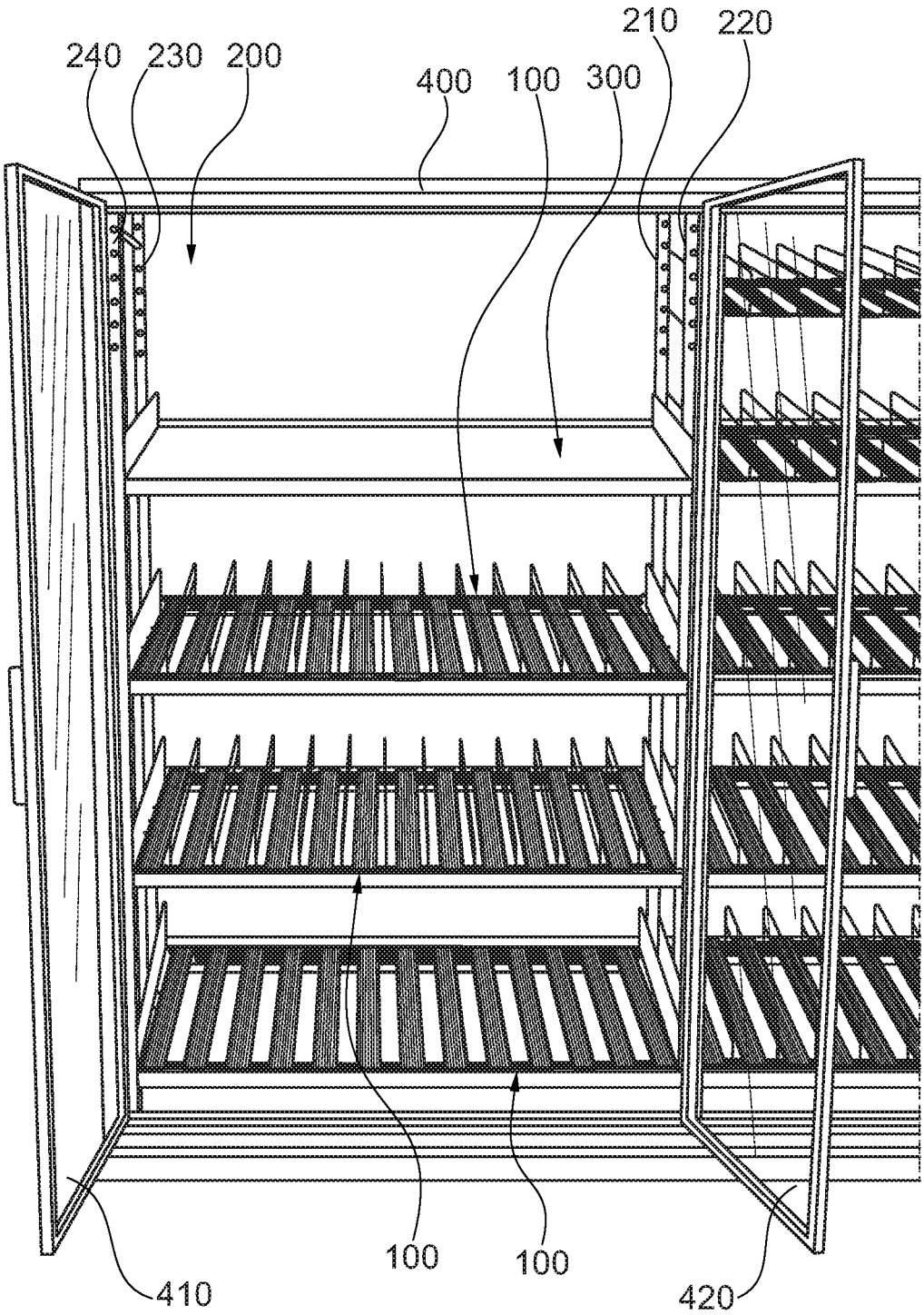
FIG. 1 shows an exemplary embodiment of a shelving system with multiple shelf units, in a perspective view.

FIG. 1 shows an example of a shelving system 200 with multiple shelf units 100, 300 and at least two, preferably four, shelf supports 210, 220, 230, 240 supporting the shelf units 100, 300. For example, shelf supports 210, 220, 230, 240 are formed as vertical supports, each of which is formed by an elongated profile.

For example, the shelf supports 210, 220, 230, 240 can be set up with one end on a floor and extend vertically upwards in their longitudinal direction. Preferably, the shelf supports 210, 220, 230, 240 are equipped with through-openings or other connecting elements, in order to be able to hang the shelf units 100, 300 on them or fasten them in any other manner, in particular to be able to fasten them detachably.

The shelving system 200 is used, for example, for the presentation and/or storage of products. FIG. 1 shows an example of the shelving system 200 arranged behind a wall 400, which has multiple door elements 410 and 420, such as swing doors. By opening the door elements 410, 420, access to the shelving system 200 is achieved. Preferably, the door elements 410, 420 are formed to be translucent and/or transparent, for example as glass doors, such that, even when the door elements 410 and 420 are closed, a customer can see the products on the shelving system 200.

The wall 400 with the door elements 410, 420 can form a partition from a salesroom, for example to separate a refrigerated room from the salesroom. The shelving system 200 can be assigned to the refrigerated room, such that the products stored and/or presented by means of the shelving system 200 are stored in a refrigerated and/or deep-frozen state.

The shelving system 200 can be a so-called sliding shelving system. The shelves and/or shelving units 100, 300 are then brought into an inclined position, such that the front end of the shelf is lower than the rear end. This encourages a sliding movement of products stored on the shelf towards the front end, for example after a buyer has removed a product from the front.

The shelf units 300 relate to an exemplary embodiment with a flat shelf and a support frame supporting the shelf. The shelf is formed to be full-surface and extends to the edges of the support frame and lies at least partially on the support frame.

Figure 2:
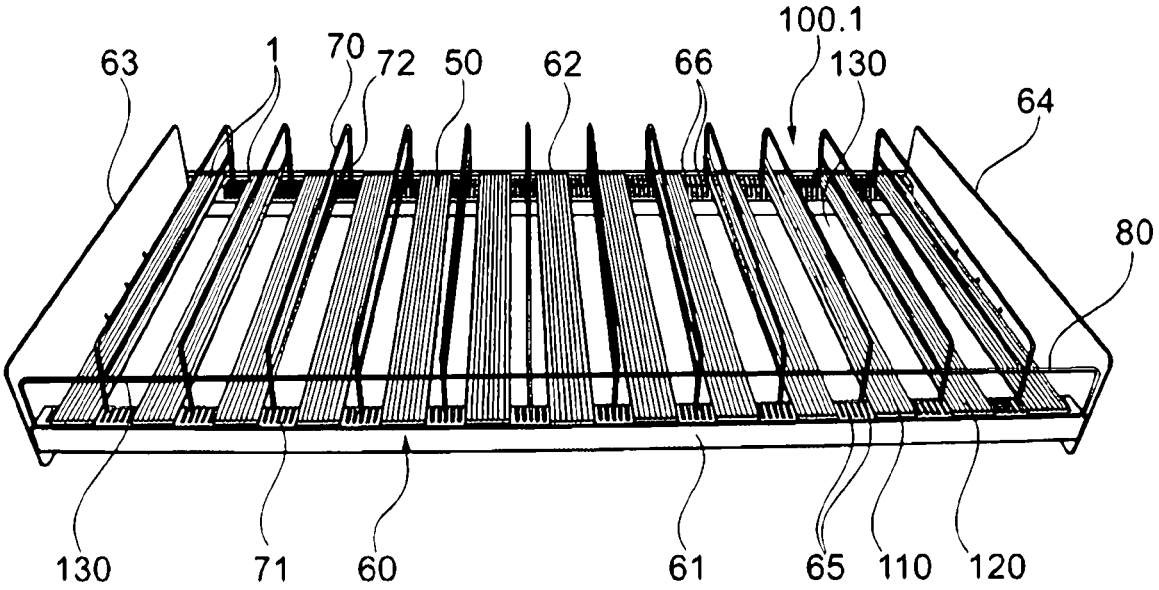
FIG. 2 shows an exemplary embodiment of a shelf unit for the shelving system according to FIG. 1 with product separators and a product stopper along with a shelf formed from a plurality of floor elements, in a perspective view.
Figure 3:
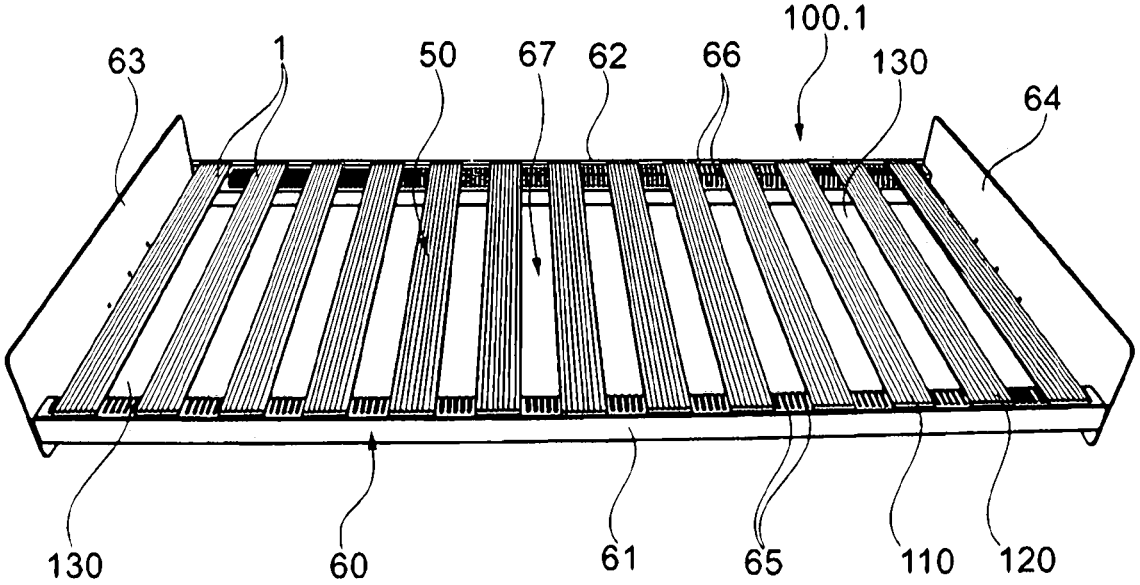
FIG. 3 shows the shelf unit according to FIG. 2 without product separators and stoppers

The shelf units 100 relate to a different embodiment. The structure and design of the shelf units 100 is explained in more detail below on the basis of shelf unit 100.1, which is shown in FIGS. 2 and 3 and can in principle form the shelf unit 100 of FIG. 1 and/or can be used with the shelving system 200 of FIG. 1. In FIG. 2, the shelf unit 100.1 has multiple product separators 70 and one product stopper 80. FIG. 3 shows an example of the shelf unit 100.1 without a product separator and without a product stopper.

The shelf unit 100.1 has a support frame 60 with a front frame part 61, a rear frame part 62 and two side frame parts 63, 64, which are connected to each other to form a through-opening 67 or an interior space; in particular, they are fastened against each other, for example screwed against each other. For example, the product stopper 80 can be arranged on the front frame part 61, in particular fastened to it (FIG. 2).

The shelf unit 100.1 also has a shelf 50, which, in contrast to the shelf of the shelf units 300, is formed by a plurality of elongated floor elements 1, of which at least two adjacent floor elements 110, 120 are arranged at a distance from one another, for example an equal distance from one another, forming an intermediate space 130.

Preferably, the front frame part 61 and the rear frame part 62 have a plurality of through-openings, which serve or can be used as insertion receptacles 65, 66. Preferably, the through-openings or insertion receptacles 65 of the front frame part 61 and the through-openings or insertion receptacles 66 of the rear frame part 62 are arranged one behind the other in the longitudinal direction of the respective frame part 61 or 62; in particular, they are arranged lying in a row, for example aligned in a row. Preferably, the through-openings or insertion receptacles 65, 66 are formed as slots or similar elongated holes, the longitudinal extension of which extends transversely to the longitudinal direction of the front frame part 61 or the rear frame part 62.

The insertion receptacles 65, 66 can be used to fasten product separators 70, as shown in FIG. 2, for example. There, for example, one of the product separators 70 is arranged between adjacent floor elements 110 and 120, for example within the intermediate space 130. One product separator 70 is inserted in one of the insertion receptacles 65 or 66 at the front frame part 61 and the rear frame part 62 of the support frame 60.

If the insertion receptacles 65, 66 are formed as slots or similar elongated holes, the longitudinal extension of which extends transversely to the longitudinal direction of the front frame part 61 or the rear frame part 62, the product separator 70 can be inserted with its ends 71, 72 into the insertion receptacles 65, 66 by a displacement movement transversely to the longitudinal direction of the frame parts 61, 62, if necessary with an additional movement from above in the direction of the shelf 50. For this purpose, plate-shaped insertion elements can be provided at the ends 71, 72 of the product separator 70, which preferably correspond or essentially correspond with the insertion receptacles 65, 66.

The through-holes or insertion receptacles 65 of the front frame part 61 and/or the through-holes or insertion receptacles 66 of the rear frame part 62 can be used to fasten the floor elements 1. Preferably, the floor elements 1 have a corresponding design, as will be explained in more detail below using different embodiments as examples.

Figure 4:
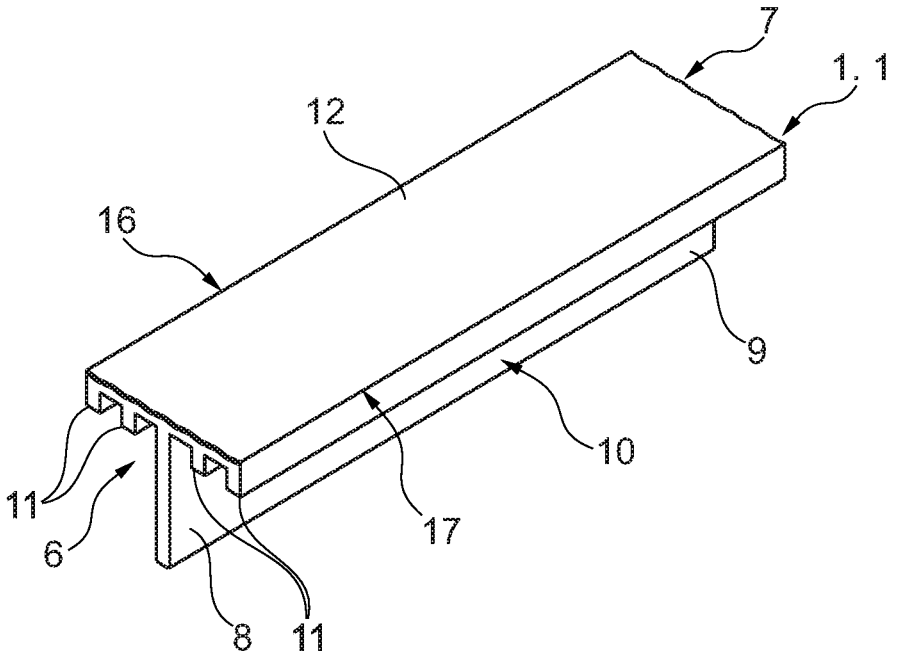
FIG. 4 shows an exemplary embodiment of a floor element, which can be used with the shelf unit of FIGS. 2 and 3, in a perspective view.
Figure 5:
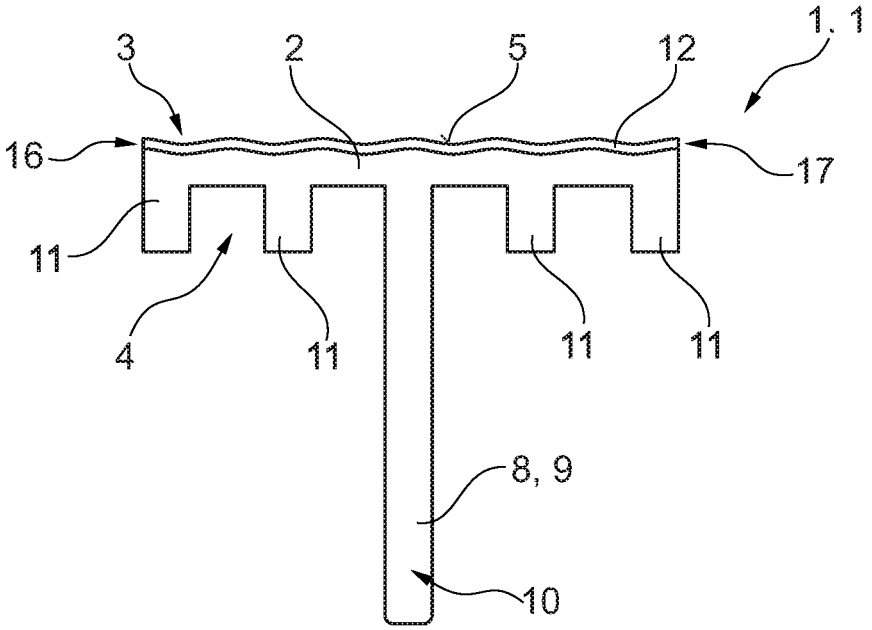
FIG. 5 shows the floor element of FIG. 4 in a sectional view.

FIGS. 4 and 5 show an exemplary embodiment of a floor element 1.1, which can be used with the shelf unit 100 of FIG. 1 and/or with the shelf unit 100.1 of FIGS. 2 and 3, in different views. The floor element 1.1 has an elongated base body 2 with an upper side 3, which has a product support surface 5.

For example, the upper side 3 has longitudinal ends 6, 7, which limit the upper side 3 in the longitudinal direction of the base body 2. For example, upper side 3 also has transverse ends 16, 17, which border the upper side 3 transverse to longitudinal direction of the base body 2. In particular, the longitudinal ends 6, 7 and/or the transverse ends 16, 17 form an edge of the upper side 3 and/or of the base body 2. For example, the longitudinal ends 6, 7 and/or the transverse ends 16, 17 also form transverse ends or longitudinal ends of the base body 2.

The longitudinal ends 6, 7 are preferably arranged opposite each other. The transverse ends 16, 17 are preferably arranged opposite each other. For example, the upper side 3 forms a quadrilateral surface, in particular a rectangular surface. For example, the upper side 3 is formed to be flat or essentially flat.

Preferably, the upper side 3 is free of projections or similar material sections, which project outwards from the upper side 3 and can serve as a lateral stop for products if necessary. This allows products to be placed on the product support surface 5, which project beyond the longitudinal ends 6, 7 and/or the transverse ends 16, 17 of the upper side 3; for example, they project beyond both sides.

In the case of the floor element 1.1, the base body 2 also has a lower side 4, which in the area of the longitudinal ends 6, 7 has a bar 8, 9, which extends in the longitudinal direction of the base body 2. The bar 8, 9 provided in the area of the respective longitudinal end 6, 7 is preferably provided as a section of a common, continuous bar 10. Preferably, the base body 2 and the at least one bar 8 or 9 or 10 is a T-shaped profile in cross-section, in particular an elongated profile. Preferably, the floor element 1.1 extends in the longitudinal direction with a constant cross-section.

The at least one bar 8 or 9 is used as an insertion element, in order to insert the floor element 1.1 at the end into one of the insertion receptacles 65, 66 of the front frame part 61 and/or the rear frame part 62. In the inserted state, the floor element 1.1 is fixed or held in a positive-locking manner in relation to the level formed by the shelf 50. The floor element 1.1 can then be detached from the support frame 60, for example, by pulling out at least one bar 8 or 9 from the at least one insertion receptacle 65 or 66.

The floor element 1.1 can be a plastic part; in particular, it can be manufactured entirely of plastic. Multiple reinforcing ribs 11 can be provided on the lower side 4 of the body 2 to reinforce the floor element 1.1 against transverse forces acting transversely to the longitudinal extension of the floor element 1.1 which are generated, for example, by the weight force of the product supported on it. Preferably, the reinforcing ribs 11 extend in the longitudinal direction of the base body 2, wherein the at least one bar 8, 9 projects beyond the reinforcing ribs 11.

Preferably, the floor element 1.1 has a sliding layer 12 on the upper side 3 of the base body 2, which facilitates the sliding or gliding of products located on the product support surface 5. The sliding layer 12 can be formed from a plastic or have a plastic. The sliding layer 12 can consist of the same material or of another material as the base body 2 and/or the at least one bar 8 or 9. The sliding layer 12 can be manufactured together with the base body 2 and the at least one bar 8, 9 by extrusion, in particular co-extrusion.

Figure 6:
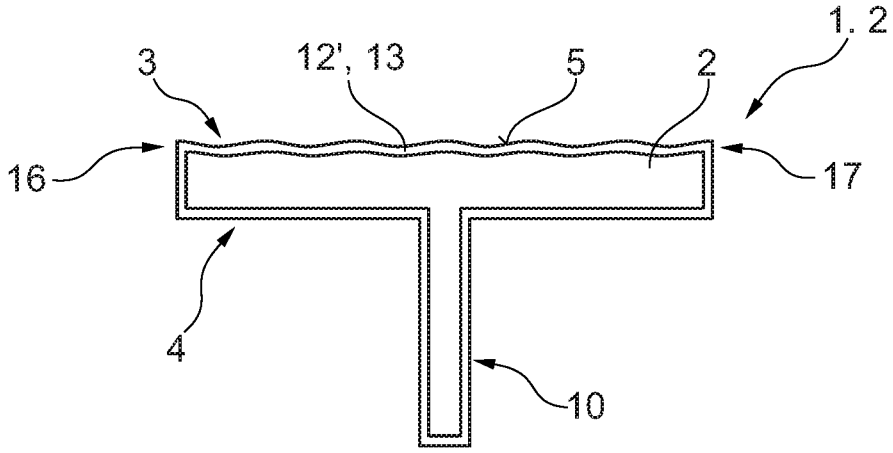
FIG. 6 shows an additional exemplary embodiment of a floor element, which can be used with the shelf unit of FIGS. 2 and 3, in a sectional view.

FIG. 6 shows another possible embodiment of a floor element 1.2 in a cross-sectional view. The floor element 1.2 is formed as a metal part there. For example, the floor element 1.2 has or consists of aluminum or an aluminum alloy. The floor element 1.2 can also have or consist of stainless steel or a stainless steel alloy. The floor element 1.2, like the floor element 1.1, is preferably formed by a T-shaped profile in cross-section. Preferably, the downwardly projecting leg of the T-shaped profile forms at least one bar 8, 9 and the two transverse legs of the T-shaped profile form the base body 2 of the floor element 1.2.

The floor element 1.2 preferably has a sliding layer 12' on the upper side 3 of the base body 2, which facilitates the sliding or gliding of products on the product support surface 5. The sliding layer 12' is preferably formed by a coating that is, for example, a paint layer 13. The paint layer 13 can surround the entire floor element 1. In principle, the floor element 1.2 can have, partially or completely, an application and/or coating for decorative and/or functional purposes of any kind.

Figure 7:
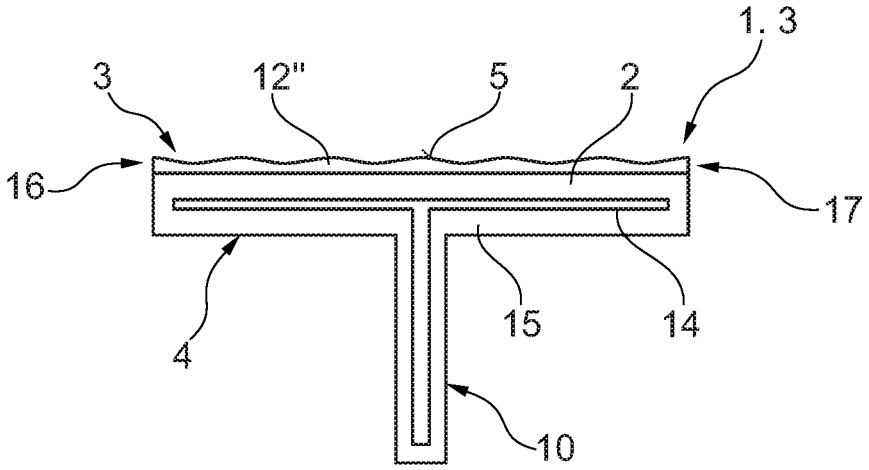
FIG. 7 shows an additional exemplary embodiment of a floor element, which can be used with the shelf unit of FIGS. 2 and 3, in a sectional view.

FIG. 7 shows an additional possible embodiment of a floor element 1.3. The floor element 1.3 differs from floor element 1.1 of FIGS. 4 and 5 and the floor element 1.2 of FIG. 6 in that it is a hybrid component. The hybrid component is structured on the basis of a plastic, through which the floor element 1.3 forms a profile, which is T-shaped in cross-section. For this purpose, a plastic with at least one thermoplastic polymer can be used as a plastic. For example, the plastic can be a polyvinyl chloride (PVC), in particular rigid PVC.

For reinforcement, the floor element 1.3 has a reinforcement insert 14, which is provided in the area of the base body 2. Preferably, the reinforcing insert 14 extends into the at least one bar 8 or 9 of the floor element 1.3. For example, the reinforcing insert 14 is formed to be T-shaped and essentially extends over the longitudinal extension of the floor element 1.3, preferably with the same cross-section. Preferably, the reinforcing insert 14 is metallic. For example, the reinforcing insert 14 has or consists of aluminum or an aluminum alloy.

A sliding layer 12" is preferably provided for the floor element 1.3, which facilitates the sliding or gliding of products on the product support surface 5. The sliding layer 12" can be formed from a plastic or can comprise a plastic. For example, the sliding layer 12" can be formed by a PTFE material or can have such a material. For example, the floor element 1.3 is formed by tri-extrusion, through which a plastic sheathing 15 around the reinforcing insert 14 and at the same time the sliding layer 12" on the upper side 3 of the base body 2 are manufactured.

LIST OF REFERENCE SIGNS

1 Floor element
1.1 Floor element
1.2 Floor element
1.3 Floor element
2 Base body
3 Upper side
4 Lower side
5 Product support surface
6 End
7 End
8 Bar
9 Bar
10 Bar
11 Reinforcing ribs
12 Sliding layer
12' Sliding layer
12" Sliding layer
13 Paint layer
14 Reinforcing insert
15 Plastic sheathing
16 End
17 End
50 Shelf
60 Support frame
61 Front frame part
62 Rear frame part
63 Lateral frame part
64 Lateral frame part
65 Insertion receptacle
66 Insertion receptacle
67 Through-opening
70 Product separator
71 End
72 End
80 Product stopper
100 Shelf unit
100.1 Shelf unit
110 Floor element
120 Floor element
130 Intermediate space
200 Shelving system
210 Shelf support
220 Shelf support
230 Shelf support
240 Shelf support
300 Shelf unit
400 Wall
410 Door
420 Door

The invention claimed is:

1. A shelf unit for a shelving system comprising a shelf, and a support frame carrying the shelf, the support frame having a front frame part having a planar upper surface with a plurality of insertion receptacles formed therein, a rear frame part having a planar upper surface with a plurality of insertion receptacles formed therein, and two lateral frame parts, which are connected to one another to form a through-opening, wherein the shelf comprises at least one elongated floor element extending between the front frame part and the rear frame part;

wherein the at least one floor element comprises:

an elongated base body;

a product support surface formed on an upper side of the elongated base body, wherein the product support surface is free from dividers and is configured to support at least one product thereon;

a vertical bar extending downwardly in longitudinal direction from a lower side of the elongated base body at a first longitudinal end thereof along a central axis of the at least one floor element to define a T-shape;

the vertical bar being configured to be inserted into respective insertion receptacles of the front frame part and the rear frame part of the support frame.

2. The shelf unit according to claim 1, wherein, the least one floor element comprises two adjacent floor elements that are arranged at a distance from one another to form an intermediate space.

3. The shelf unit according to claim 1, wherein the lower side of the elongated base body of each floor element (1.1; 1.2; 1.3) rests on the front frame part and the rear frame part.

4. The shelf unit according to claim 3, wherein a product separator is arranged between the respective two adjacent floor elements, the product separator having a first longitudinal end which is inserted into one of the insertion receptacles of the front frame part and a second longitudinal end which is inserted into one of the insertion receptacles of the rear frame part.

5. The shelf unit according to claim 1, wherein a plurality of reinforcing ribs are provided on the lower side (4) of each elongated base body and extend in the longitudinal direction, and wherein, for each floor element, the vertical bar projects beyond the reinforcing ribs.

6. The shelf unit according to claim 1, wherein each product support surface defines a sliding layer.

7. The shelf unit according to claim 1, wherein each floor element is an extruded plastic part.

8. The shelf unit according to claim 1, wherein each floor element is made of metal.

9. The shelf unit according to claim 1, wherein each floor element is made of aluminum or an aluminum alloy.

10. The shelf unit according to claim 1, wherein each floor element is a hybrid component, which is manufactured from plastic and has a metallic reinforcing insert.

11. The shelf unit according to claim 1, wherein each reinforcing insert is T-shaped.

12. A shelving system comprising a front, a rear, at least two shelf supports, and at least one shelf unit according to claim 1, wherein the at least one shelf unit is supported on the at least two shelf supports and is inclined downwards in the direction of the front of the shelving system.

* * * * *